US005427002A

United States Patent [19]

Edman

[11] Patent Number: 5,427,002

[45] Date of Patent: Jun. 27, 1995

[54] POWER DRIVE UNIT FOR HAND TOOLS

[76] Inventor: Brian R. Edman, 1216 Hosmer St., Joliet, Ill. 60435

[21] Appl. No.: 229,989

[22] Filed: Apr. 19, 1994

[51] Int. Cl.[6] ..... B25B 17/00

[52] U.S. Cl. ..... 81/57; 81/57.11; 173/29; 173/216; 173/217

[58] Field of Search ..... 7/158; 173/29, 216, 173/217; 81/54, 57, 57.11, 57.14; 362/109, 119

[56] References Cited

U.S. PATENT DOCUMENTS

| | | | |
|---|---|---|---|
| 2,525,588 | 10/1950 | Cameron et al. | 362/119 |
| 3,724,237 | 4/1973 | Wood | 173/29 |
| 4,945,790 | 8/1990 | Golden | 81/57.14 |
| 5,083,620 | 1/1992 | Fushiya et al. | 173/217 |
| 5,094,133 | 3/1992 | Schreiber | 173/29 |
| 5,161,437 | 10/1992 | Yasutomi et al. | 81/57.14 |
| 5,169,225 | 12/1992 | Palm | 362/119 |
| 5,261,135 | 11/1993 | Mitchell | 7/158 |

FOREIGN PATENT DOCUMENTS

| | | | |
|---|---|---|---|
| 322382 | 12/1929 | United Kingdom | 362/119 |

*Primary Examiner*—Bruce M. Kisliuk
*Assistant Examiner*—Joni B. Danganan
*Attorney, Agent, or Firm*—Ernest Kettelson

[57] ABSTRACT

A power drive unit for hand tools such as hand operated screwdrivers with a handle at one end, comprising a relatively large diameter cylindrical drive shaft having an annular chuck assembly secured at one end provides a relatively large diameter passageway therethrough. It is located on the upper wall of a casing having an electric motor and a battery therein, or a cord for connection to an external power source. A ring gear around the cylindrical drive shaft is rotated by a gear assembly powered by the electric motor to rotate the cylindrical drive shaft and chuck together with whatever tool is received therein. The location of the cylindrical drive shaft and annular chuck assembly provides a clear and unobstructed pathway both forwardly and rearwardly of the passageway therethrough. A hand operated screwdriver, for example has its working end inserted through the rearward facing end of the cylindrical passageway and out through the forward facing end to a desired working position. The opposite end of the screwdriver having a handle thereon extends rearwardly of the cylindrical drive shaft with enough clear and unobstructed space to utilize a hand operated screwdriver of any length. The chuck is then tightened down on the shank of the screwdriver. The motor is energized to drive the gear assembly and thus rotate the screwdriver. A lamp is also provided in the casing to illuminate the working area.

12 Claims, 5 Drawing Sheets

POWER DRIVE UNIT FOR HAND TOOLS

BACKGROUND OF THE INVENTION

This invention relates to the field of power driven rotary tools and in particular to a power drive unit that can receive and operate tools designed for operation by hand such as ordinary hand operated screwdrivers.

Prior art devices relevant to this invention of which the inventor is aware include those described and shown in the following United States patents.

U.S. Pat. No. 4,949,463 discloses a mechanism for connection to a regular electric drill which converts rotary motion of the drill to reciprocating motion of an eccentric strut to which a saw blade may be attached.

U.S. Pat. No. 4,480,512 discloses a screwdriver which can be used manually as well as connected to a power drill for powered operation. The handle has a recess in which a coupling shaft is received for movement into such recess for manual use of the screwdriver and out from such recess for gripping by the chuck of a power drill for operation in the power mode.

U.S. Pat. No. 4,437,365 also discloses a screwdriver which can be used manually as well as connected to a power drill for powered operation. An adapter fitting which includes a short shaft having an angular cross-sectional configuration, is received at one end in the chuck of a power drill and at the other end in an angular cross-section recess in the handle of the screwdriver opening to its outer end.

U.S. Pat. No. 4,161,242 discloses a power driven drill and screwdriver having two clutches movable to provide either a positive drive connection between the motor and tool element or a drive connection that can be established and interrupted at will by the person operating the tool.

U.S. Pat. No. 2,457,829 discloses a power driven hand hacksaw, which includes a rotatable drive shaft having an endless groove in the form of a double helix wherein the grooved turns of each helix intersect. An insert lug received in such endless double helix groove is moved forward to one end of the grooved drive shaft as it rotates, then backward to the other end of the grooved drive shaft, continuing such back and forth reciprocating motion as the drive shaft continues to rotate in the same direction of rotation. The hack saw blade is secured to the insert lug and thereby moved back and forth in a sawing operation as the grooved drive shaft is rotated.

U.S. Pat. No. 1,808,228 discloses an attachment for electric drills which includes a rotating barrel cam that guides a cam follower to impart reciprocating motion to a tool such as a saw blade, a file and the like.

The present invention is an improvement over prior art devices in that it enables using a power tool to drive rotatable hand tools such as ordinary screwdrivers, drill bits that are normally used with a hand operated brace, and other rotatable hand tools which have a working end and an opposite end too large to be received in the chuck of prior art power tools such as power drills.

SUMMARY OF THE INVENTION

The present invention includes a relatively large diameter cylindrical drive shaft having an annular chuck assembly secured to one end that provides a relatively large through passageway able to receive the working end of an elongated hand tool therethrough from the rearwardly facing end. The working end projects outwardly from the forwardly facing end to a working position whereupon the chuck is tightened down on the shank of the tool. The opposite end of the hand tool extends rearwardly of the cylindrical drive shaft.

The cylindrical drive shaft is positioned on the outer wall of a casing where the longitudinal axis of the passageway through such drive shaft is clear and unobstructed both forwardly and rearwardly. Thus, an elongated hand tool of virtually any length can be rotated and used with this invention, having its working end positioned a selected short distance in front and its opposite end extending rearwardly through the clear and unobstructed space as far as necessary.

A ring gear around the cylindrical drive shaft is driven by a gear assembly powered by an electric motor mounted in the casing. Such electric motor is powered by a battery also carried in the casing, or by an electrical cord connected to an external power source.

Further advantages and improvements of the power drive unit for hand tools in accordance with the present invention will become apparent from the more detailed description which follows and from the accompanying drawing.

DESCRIPTION OF PREFERRED EMBODIMENT

Figure 1:
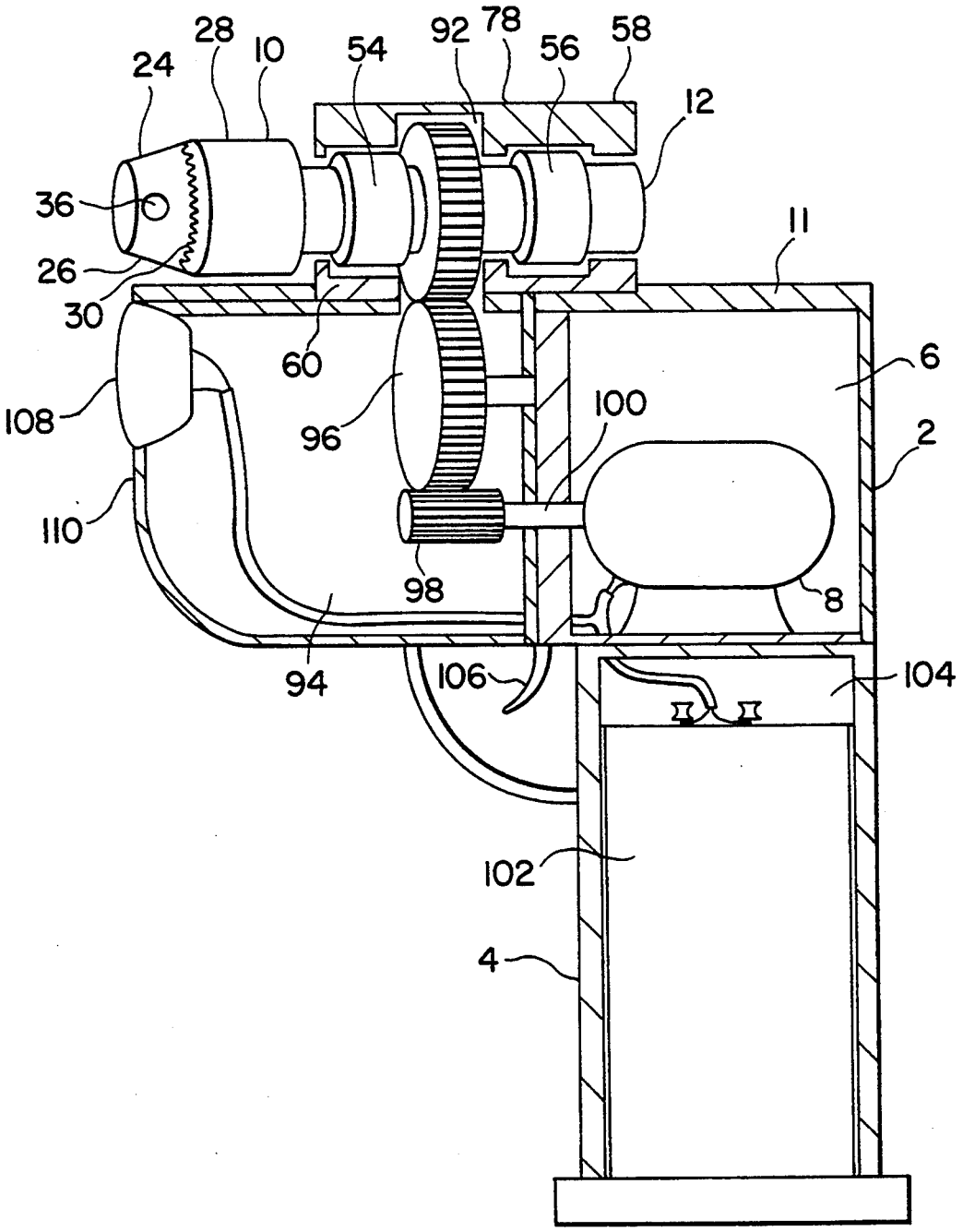
FIG. 1 is a side elevation view of a cylindrical operating shaft and chuck assembly connected to a battery powered motor within a hand held casing shown in section to illustrate the connection of the operating components
Figure 2:
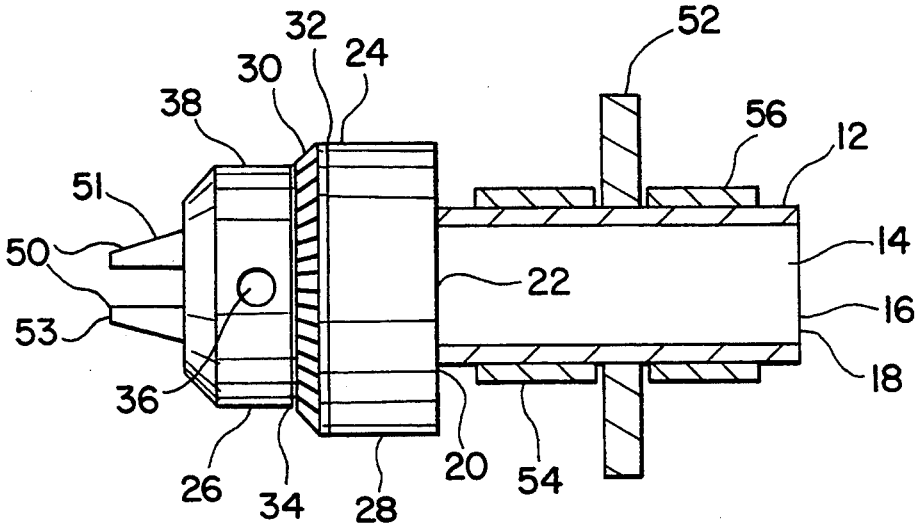
FIG. 2 is a section view of the cylindrical operating shaft and a side elevation view of the annular chuck to which it is connected, illustrating the passageway through the cylindrical operating shaft, the jaw members of the chuck shown in a partially closed position.
Figure 3:
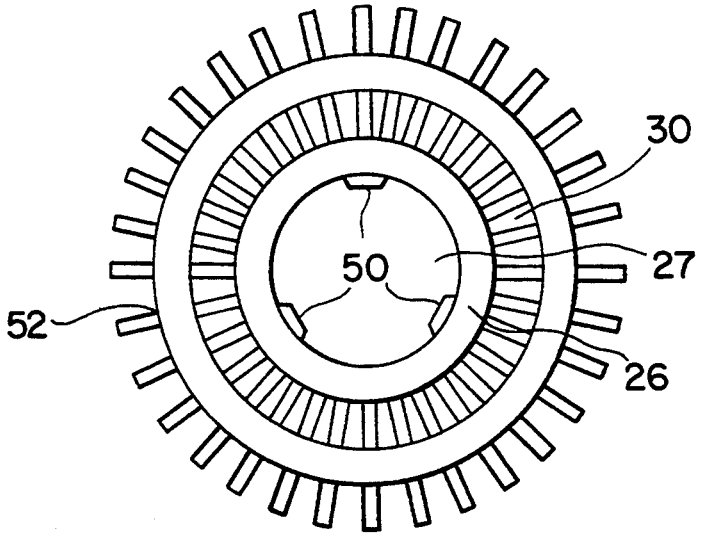
FIG. 3 is a front end view, somewhat enlarged, of the annular chuck and cylindrical operating shaft assembly shown in FIG. 2, but wherein the jaw members are in their open position.
Figure 4:
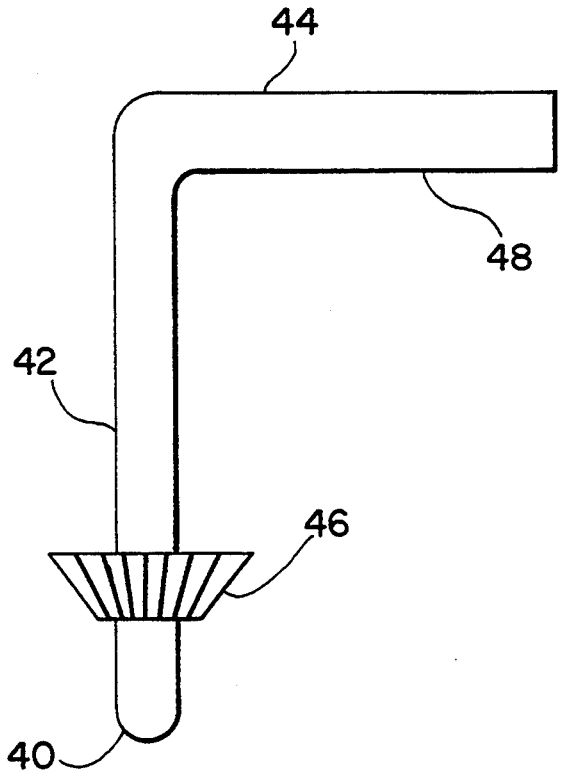
FIG. 4 is an elevation view of a tool to tighten and loosen the jaws of the chuck.
Figure 5:
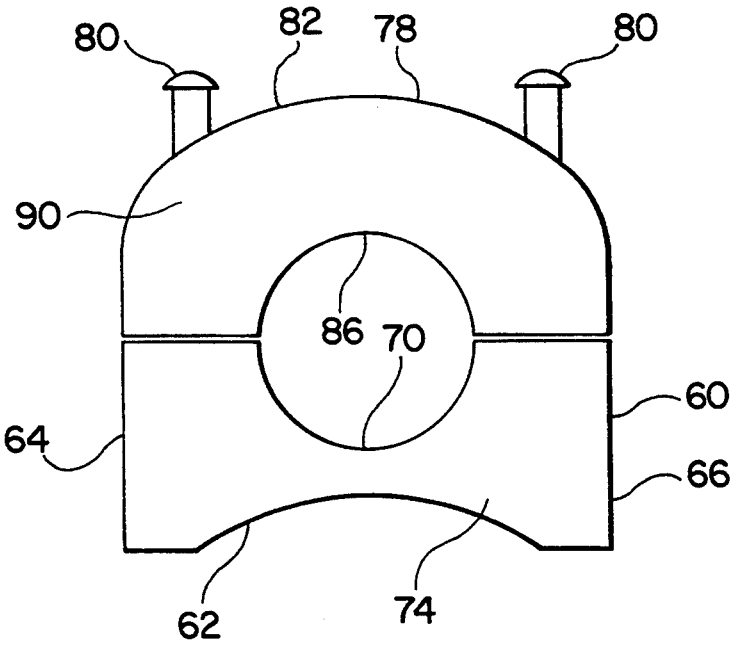
FIG. 5 is an end elevation view of the mounting assembly for the cylindrical operating shaft and chuck assembly.
Figure 6:
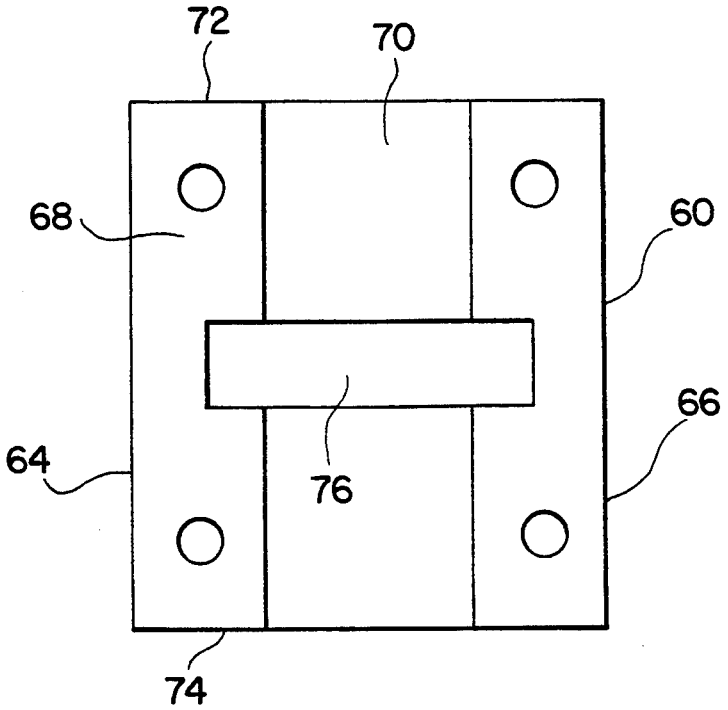
FIG. 6 is a top plan view of the base portion of the mounting assembly shown in FIG. 5.
Figure 7:
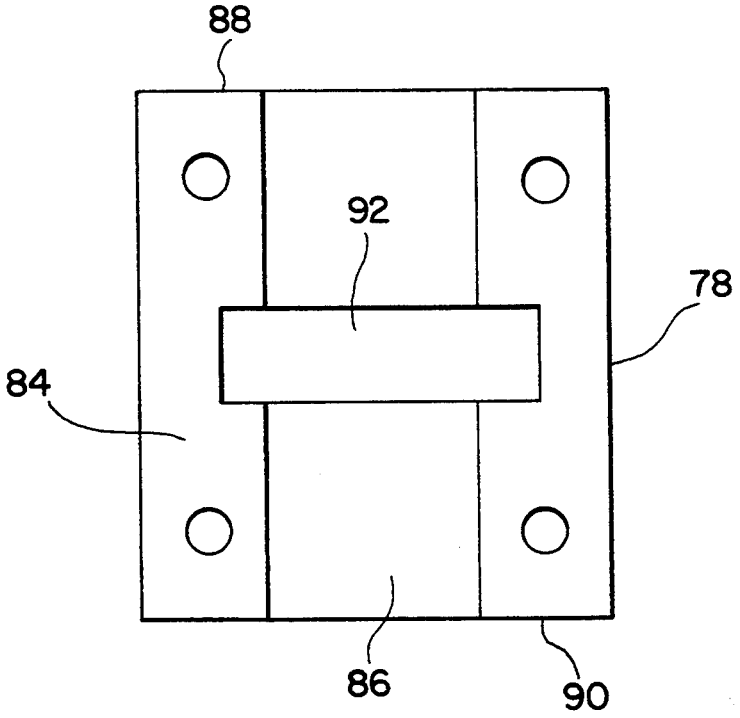
FIG. 7 is a bottom plan view of the retaining cap portion of the mounting assembly shown in FIG. 6.
Figure 8:
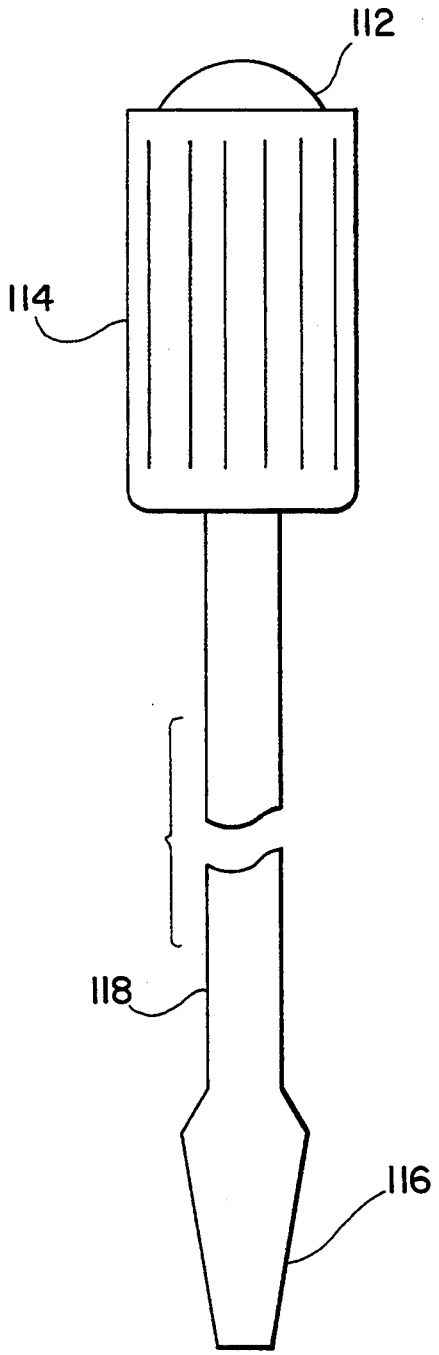
FIG. 8 is an elevation view of a screwdriver which the cylindrical operating shaft and annular chuck assembly in accordance with this invention can receive therethrough and secure for rotation by operation of the motor, thereby enabling use of an ordinary hand held screwdriver as a power driven tool.

A power drive assembly for hand tools in accordance with the present invention comprises a hand held casing 2 having a hand grip 4, a motor compartment 6 having an electric motor 8 therein connected to drive a rotatable chuck assembly 10 mounted along the upper wall 11 of the casing 2.

The rotatable chuck assembly 10 includes an elongated cylindrical drive shaft 12 having a cylindrical through passageway 14 opening at the rearward end 16 to an entrance aperture 18 and the forward end 20 to an outlet aperture 22.

A chuck member 24 is secured to the cylindrical drive shaft 12 at its forward end 20. The chuck member 24 includes a cylindrical collar 26 secured to the forward end 20 of the cylindrical drive shaft 12 to rotate therewith. The cylindrical chuck collar 26 has a through passageway 27 in registration and axial alignment with the through passageway 14 of the cylindrical drive shaft 12.

The chuck member 24 includes an operating cylinder 28 comprising an annular chamber rotatably mounted on the cylindrical drive shaft 12, positioned rearwardly of the chuck collar 26. A bevel ring gear 30 is secured to the forward facing annular wall 32 of the operating cylinder 28 adjacent the rearward facing annular wall 34 of the chuck collar 26. Tool receiving cylindrical recesses 36 are provided in radially spaced apart locations around the cylindrical wall 38 of the chuck collar 26 to receive the insert end 40 of rotatable tool shaft 42 of a jaw adjusting tool 44 having a bevel gear 46 thereon which meshes with bevel ring gear 30 of the operating cylinder 28 when the insert end 40 of tool 44 is received in one of the tool receiving recesses 36. An adjusting tool handle 48 extends laterally from the rotatable tool shaft 42 for rotating the bevel gear 46 secured thereto and in turn rotating the bevel ring gear 30 and the operating cylinder 28 relative to the chuck collar 26.

Three radially spaced apart jaw members 50 extend through the passageway 27 of the chuck collar having outwardly facing tapered cam surfaces 51 at their forward ends 53 bearing against a corresponding surface of the inner wall of the chuck collar 26. The inwardly facing surfaces of the jaw members 50 have gripping ridges to tightly grip the shank of a tool when received through the chuck collar passageway 27 and the cylindrical drive shaft passageway 14 and when the operating cylinder 28 is rotated relative to the chuck collar 26 to bring the jaw members 50 inwardly to tightly grip the shank of such tool.

The rearward ends of the jaw members 50 are mounted within the annular chamber of the operating cylinder 28 to move forwardly and radially inwardly to tighten when the operating cylinder 28 is rotated relative to the chuck collar 26 in one direction, and to move rearwardly and radially outwardly to loosen when the operating cylinder 28 is rotated relative to the chuck collar 26 in the opposite direction.

An operating ring gear 52 is secured to the elongated cylindrical drive shaft 12 rearwardly of the chuck member 24, to rotate the drive shaft 12 when the gear 52 is rotated. A first cylindrical bearing 54 is mounted on the cylindrical drive shaft 12 adjacent the forwardly facing side of the gear 52 and a second cylindrical bearing 56 is mounted on the cylindrical drive shaft 12 adjacent the rearwardly facing side of the gear 52.

A chuck assembly housing 58 is secured to the upper wall 11 of the hand held casing 2 to receive the rotatable chuck assembly 10 therein. The chuck assembly housing 58 includes mounting base 60 comprising a bottom wall 62 secured to the upper wall 11 of the casing 2, side walls 64 and 66 extending upwardly from the bottom wall 62 and an upwardly facing wall 68. A semi-cylindrical cavity 70 extends from the forward housing wall 72 to the rearward housing wall 74 through the longitudinal mid-line of the mounting base 60 having a cross-sectional dimension and configuration corresponding to that of the lower half of the cylindrical bearings 54 and 56 for reception therein.

A gear receiving aperture 76 extends laterally across the interior of the mounting base 60 intersecting the semi-cylindrical cavity 70. The operating ring gear 52 extends into and through the gear receiving aperture 76 when the rotatable chuck assembly 10 is placed in the mounting base 60 with the cylindrical bearings 54 and 56 seated in the semi-cylindrical cavity 70.

The chuck assembly housing 58 includes a retaining cap 78 secured to the mounting base 60 by screws 80. The retaining cap 78 includes an outer peripheral wall 82 extending upwardly from each side edge of a downwardly facing wall 84 which rests against the upwardly facing wall 68 of the mounting base 60 when the retaining cap 78 is in place thereon.

A semi-cylindrical cavity 86 extends from the forward retaining cap wall 88 to the rearward retaining cap wall 90 through the longitudinal mid-line of the retaining cap 78 having a cross-sectional dimension and configuration corresponding to that of the upper half of the cylindrical bearings 54 and 56 for reception therein when the retaining cap 78 is secured in place over the mounting base 60.

A gear receiving recess 92 extends across the interior of the retaining cap 78 intersecting the semi-cylindrical cavity 86. The operating ring gear 52 extends into the gear receiving recess 92 when the rotatable chuck assembly is in place on the mounting base and the retaining cap 78 is secured to the mounting base 60.

The upper wall 11 of the hand held casing 2 has a laterally extending gear receiving recess 92 opening to the cavity 94 of the casing 2 and positioned to receive the lower portion of the operating ring gear 52 into the cavity 94 where it meshes with a transmission gear 96 driven by drive gear 98 on the drive shaft 100 of the motor 8.

A battery 102 in battery compartment 104 of the hand grip 4 provides power for the electric motor 8. In the alternative, the motor 8 may be powered by connecting to an external electric power source.

A trigger switch 106 is provided adjacent the hand grip 4 to energize the electric motor when pulled to thereby rotate the operating ring gear 52 and the rotatable chuck assembly 10.

A work illuminating lamp 108 is mounted in the front wall 110 of the casing 2 facing forward, connected in the operating circuit which connects the motor 8 to its power source, to illuminate the work area in front when the trigger switch 106 is pulled to energize the motor 8 and operate the rotatable chuck assembly 10.

The through passageway 14 extending through the elongated cylindrical drive shaft 12 of the rotatable chuck assembly enables use of the power drive assembly of this invention to drive ordinary hand tools such as screw drivers, socket wrench extensions, Allen wrenches, drill bits and the like.

A regular screw driver 112 for example having a hand grasp 114 at one end for rotating by hand, can have its screw engaging end 116 received through the entrance aperture 18 of the rotatable chuck assembly 10, through the outlet aperture 22, and through the passageway 27 of the chuck collar 26 to extend outwardly therefrom to a working position of the screw engaging end 116. The jaw members 50 of the chuck member 24 are then tightened down on the shank 118 of the screwdriver 112 by rotating the operating cylinder 28 relative to the chuck collar 26 in the tightening direction of rotation.

The chuck assembly housing 58 is positioned on the upper wall 11 of the casing 2 to hold the cylindrical drive shaft 12 of the rotatable chuck assembly 10 and its through passageway 14 clear and unobstructed both forwardly thereof and rearwardly thereof. By this means the power drive assembly in accordance with this invention is able to receive and operate an elongated hand tool having an enlarged hand grasp at one end, by being able to place the working end of the tool in the entrance aperture 18 of the cylindrical drive shaft 12 with the enlarged hand grasp of the tool rearwardly in the unobstructed space, then pushing the tool forwardly until the working end exits from the outlet aperture 22 and from the passageway 27 of the chuck collar 26, pushing the working end forward far enough to a desired working position.

The diameter of the cylindrical drive shaft 12 and chuck member 24, and their respective passageways 14 and 27, may be as large as desired to receive the working end therethrough of any desired size of any rotatable tool. The power drive assembly in accordance with this invention is thus able to receive and operate rotatable tools of any length and having working ends of any size cross-section.

I claim:

1. A power drive assembly for hand tools comprising an elongated tubular drive shaft, a passageway through said tubular drive shaft having a cross-sectional dimension large enough to receive the working portion of a rotatable hand tool therethrough, said passageway opening at one end to an entrance aperture for entrance of a portion of a hand tool therethrough and opening at the opposite end to an outlet aperture for exit of said portion of said hand tool therefrom, mounting means to mount said tubular drive shaft for rotation, operating means to rotate said tubular drive shaft and securing means to hold a portion of a said rotatable hand tool received in said passageway of said tubular drive shaft from rotation relative to said tubular drive shaft as it is rotated by said operating means, wherein said mounting means includes a hand held casing, said tubular drive shaft being mounted for rotation on said casing, said casing having a hand grip, said operating means includes an electric motor in said casing and a gear assembly connected between said tubular drive shaft and said electric motor to rotate said tubular drive shaft when said electric motor is energized, wherein. Said gear assembly includes a ring gear around said tubular drive shaft and secured thereto to rotate said tubular drive shaft when said ring gear is rotated., said motor includes a drive shaft, a drive gear on said drive shaft to rotate therewith, said drive gear and said ring gear being operatively associated in said gear assembly whereby said ring gear is rotated to rotate said tubular drive shaft when said drive gear is rotated by said motor, wherein said gear assembly includes a transmission gear, said transmission gear being connected between said ring gear and said drive gear and in mesh with each.

2. A power drive assembly for hand tools comprising an elongated tubular drive shaft, a passageway through said tubular drive shaft having a cross-sectional dimension large enough to receive the working portion of a rotatable hand tool therethrough, said passageway opening at one end to an entrance aperture for entrance of a portion of a hand tool therethrough and opening at the opposite end to an outlet aperture for exit of said portion of said hand tool therefrom, mounting means to mount said tubular drive shaft for rotation, operating means to rotate said tubular drive shaft and securing means to hold a portion of a said rotatable hand tool received in said passageway of said tubular drive shaft from rotation relative to said tubular drive shaft as it is rotated by said operating means, wherein said tubular drive shaft is cylindrical, wherein said mounting means includes a casing having an outwardly facing wall, a cylindrical drive shaft mount on said outwardly facing wall to operatively hold said cylindrical drive shaft therein for rotation and positioned whereby entrance into, through and out of said passageway of said cylindrical drive shaft is clear and unobstructed.

3. A power drive assembly for hand tools as set forth in claim 2, wherein said operating means includes a ring gear secured around an intermediate portion of said cylindrical drive shaft and drive means to rotate said ring gear and said cylindrical drive shaft secured thereto, a first cylindrical bearing around said cylindrical drive shaft on one side of said ring gear, a second cylindrical bearing around said cylindrical drive shaft on the other side of said ring gear, said cylindrical drive shaft mount includes a base secured to said outwardly facing wall of said casing, said base including an upwardly facing wall, a semi-cylindrical cavity in said base opening to said upwardly facing wall and extending longitudinally thereof to receive the lower portion of said cylindrical drive shaft therein, a laterally extending aperture through said base to receive the lower portion of said ring gear therethrough, said cylindrical drive shaft mount having a retaining cap, said retaining cap including a downwardly facing wall, a semi-cylindrical cavity in said retaining cap opening to said downwardly facing wall and extending longitudinally thereof to receive the upper portion of said cylindrical drive shaft therein, a laterally extending recess in said retaining cap to receive the upper portion of said ring gear therein, said retaining cap being secured to said base with said downwardly facing surface of said retaining cap resting on said upwardly facing surface of said base.

4. A power drive assembly for hand tools as set forth in claim 2, wherein said mounting means includes a lamp positioned on said casing to illuminate a work area, and means to connect said lamp to an energy source.

5. A power drive assembly for hand tools as set forth in claim 4, wherein said operating means includes an electric motor in said casing, said casing includes a hand grip, a battery compartment, and a battery connected to power said motor.

6. A power drive assembly for hand tools as set forth in claim 2, wherein said securing means includes a chuck assembly at one end of said tubular drive shaft, said chuck assembly having a passageway therethrough in axial alignment with said passageway through said tubular drive shaft.

7. A power drive assembly for hand tools as set forth in claim 6, wherein said chuck assembly includes a chuck collar, an operating cylinder adjacent to said chuck collar, jaw members extending from said operating cylinder through said chuck collar movable between a jaw open position and a jaw closed position by rotation of said operating cylinder relative to said chuck collar.

8. A power drive assembly for hand tools and a hand held screwdriver in combination, said screwdriver having a hand grasp at one end, a shank, and screw engaging means at the other screw engaging end, said power drive assembly comprising an elongated tubular drive shaft, a passageway through said tubular drive shaft having a cross-sectional dimension large enough to receive said screw engaging end of said screwdriver therethrough, said passageway opening at one end to an entrance aperture for entrance of said screw engaging end of said screwdriver therethrough and opening at the opposite end to an outlet aperture for exit of said screw engaging end of said screwdriver therefrom, mounting means to mount said tubular drive shaft for rotation, operating means to rotate said tubular drive shaft, and securing means to hold said shank of said screwdriver in said passageway of said tubular drive shaft from rotation relative to said tubular drive shaft as it is rotated by said operating means to thereby also rotate said screwdriver and its said screw engaging end.

9. A power drive assembly for hand tools and a hand held screwdriver in combination as set forth in claim 8, wherein wherein said mounting means includes a casing, a lamp positioned on said casing to illuminate a work area, and means to connect said lamp to an energy source.

10. A power drive assembly for hand tools and a hand held screwdriver in combination as set forth in claim 9, wherein said operating means includes an electric motor in said casing, said casing includes a hand grip, a battery compartment, and a battery connected to power said motor.

11. A power drive assembly for hand tools and hand held screwdriver in combination as set forth in claim 8, wherein said securing means includes a chuck assembly at one end of said tubular drive shaft, said chuck assembly having a passageway therethrough in axial alignment with said passageway through said tubular drive shaft.

12. A power drive assembly for hand tools and a hand held screwdriver in combination as set forth in claim 11, wherein said chuck assembly includes a chuck collar, an operating cylinder adjacent to said chuck collar, jaw members extending from said operating cylinder through said chuck collar movable between a jaw open position and a jaw closed position by rotation of said operating cylinder relative to said chuck collar.

* * * * *